US006589399B1

(12) United States Patent
Shimamura et al.

(10) Patent No.: US 6,589,399 B1
(45) Date of Patent: Jul. 8, 2003

(54) ELECTROLYSIS APPARATUS HAVING LIQUID SQUEEZER OUT OF CONTACT WITH STRIP

(75) Inventors: Michihiro Shimamura, Kitakyushu (JP); Masaharu Sanada, Kitakyushu (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/269,487

(22) PCT Filed: Sep. 25, 1997

(86) PCT No.: PCT/JP97/03415

§ 371 (c)(1),
(2), (4) Date: Oct. 20, 1999

(87) PCT Pub. No.: WO98/14642

PCT Pub. Date: Apr. 9, 1998

(30) Foreign Application Priority Data

Sep. 30, 1996 (JP) ..... 8-280273

(51) Int. Cl.[7] ..... C25D 17/00; C25B 15/00; C25B 9/00

(52) U.S. Cl. ..... 204/206; 204/232; 204/275.1

(58) Field of Search ..... 204/206, 232, 204/275.1

(56) References Cited

U.S. PATENT DOCUMENTS

| | | | | |
|---|---|---|---|---|
| 4,162,955 A | * | 7/1979 | Schregenberger | 204/299 |
| 5,236,566 A | * | 8/1993 | Tsuchiya et al. | 204/206 |
| 5,264,096 A | * | 11/1993 | Jorgens | 204/180.2 |
| 5,786,556 A | * | 7/1998 | Gronlund et al. | 205/705 |

FOREIGN PATENT DOCUMENTS

| | | | |
|---|---|---|---|
| JP | 5-78890 | | 3/1993 |
| JP | 5-171495 | | 7/1993 |
| JP | 5-331686 | | 12/1993 |
| JP | 0720749 A | * | 8/1995 |
| JP | 7-207492 | * | 8/1995 |

* cited by examiner

*Primary Examiner*—Donald R. Valentine
(74) *Attorney, Agent, or Firm*—Kenyon & Kenyon

(57) ABSTRACT

In an electrolytic apparatus that passes a strip between paired members of a liquid throttle unit provided on at least one of an inlet side and an outlet side of a treatment cell through which the strip is continuously passed, an electrolytic apparatus with strip non-contacting liquid throttle unit is provided which is characterized in that the spacing between the paired members of the liquid throttle unit is set very slightly larger than the thickness of the passed strip to maintain the surfaces of the strip and the liquid throttle unit members, e.g. a seal roll, nozzle device or wedge-shaped block, in a non-contacting state.

3 Claims, 9 Drawing Sheets

ELECTROLYSIS APPARATUS HAVING LIQUID SQUEEZER OUT OF CONTACT WITH STRIP

TECHNICAL FIELD

This invention relates to an electrolytic apparatus with a liquid throttle unit that establishes non-contacting sealing between a strip and a liquid electrolyte during electrolytic plating, of the surface of a metal strip, with tin, zinc, chromium or other metal or during pickling or other surface treatment.

BACKGROUND TECHNOLOGY

Numerous methods and apparatuses have been proposed for electrolytic plating of the surface of a metal strip with tin, zinc, chromium or other metals. Recently, particular demand has arisen for high-efficiency, high-speed plating equipment that offers high performance in excess of 500 m/min. For such high-speed plating, however, a specific requirement must be met, because, in the vertical type plating apparatus, the strip passes vertically and the running strip penetrates a portion of the cell body at its bottom end, while in the horizontal type plating apparatus the strip passes horizontally and the running strip laterally penetrates a center portion of the cell body. In order to conduct the plating (including pickling and other treatments) while continuously moving the metal strip to be plated, it is therefore necessary to seal the penetrated portion so as to prevent leakage of the treatment liquid. This is because the constant running state of the strip results in the plating treatment liquid also being leaked as an entrained flow along the running strip surface.

Specifically, as shown in FIG. 1, the amount of plating treatment liquid leakage owing to entrained flow is proportional to strip running speed. It was found that at a strip running speed of around 200 m/min, the amount of plating treatment liquid leakage (loss) rises to 20% or more of the fed treatment liquid, at a strip running speed of about 500 m/min, it reaches 80% or higher, and at 1000 m/min, the maximum strip running speed currently conceivable, the amount of leakage reaches nearly 100%. With such increasing leakage, the amount of treatment liquid fed must be increased to continue operation with the plating treatment cell kept constantly full.

Sealing methods for preventing treatment liquid leakage include one, such as taught by JP-A-(unexamined published Japanese patent application)5-331695, in which a pair of damrolls are installed one on either side of the strip pass line to be rotatable in contact with the strip surface, the opposite axial ends of the damrolls are sealed by seal rings from the outside, and seal plates are installed for sealing by contact with the peripheral surfaces of the damrolls. This method, which is an improvement on the well-known rotating seal system, enables the sealing capability with respect to the strip surface to be increased substantially in proportion to the squeezing force between the damrolls.

FIG. 12 illustrates a vertical type electrolytic apparatus disclosed by JP-A-5-171495. As shown, liquid electrolyte 103 is fed between a strip 100 and electrodes 101, 102 to impart an agitation effect between the strip and the electrodes. In addition, liquid seal devices 104*a* and 104*b* equipped with seal rolls 105*a*, 105*b* are installed at the lowermost portion of the vertical type electrolytic apparatus for preventing runoff of the liquid electrolyte 103, thereby obtaining a high current density while maintaining the level of the liquid electrolyte.

As shown in FIG. 13, a vertical type electrolytic apparatus disclosed in JP-A-60-56092 (U.S. Pat. No. 5,236,566) imparts an agitation effect between a strip 115 and a liquid electrolyte 110 by using liquid feed nozzles 113 and 114 to feed liquid electrolyte into spaces between electrodes 1.11 and electrodes 112 immersed in the liquid electrolyte 110.

In the method of squeezing the strip with damrolls, however, the strip surface tends to be easily scratched. One reason for this is that the squeezing force of the rolls on the strip has to be maintained high in order to secure sealing pressure. Another is that contact scratches are produced between the strip and the roll surfaces owing to mismatching between the strip running speed and the circumferential speed of the rolls. What happens most often, however, is that sludge carried in from the exterior and, particularly in the electrolytic cell, foreign matter such as electrolytic deposits, get into the treatment liquid and lodge between the strip surface and the damrolls to become sources of scratching. This lowers production yield, degrades quality, makes more frequent roll inspection and exchange necessary, and leads to a decline in production line operating rate. In a case where the strip passes between the seal rolls while running in a meandering state, moreover, if the strip should snake in the manner of weaving in the axial direction of the rolls, then, since the strip is squeezed between the rolls, the portions of the strip strongly squeezed by the rolls pass with no freedom in the thrust direction, thereby producing wrinkles in the strip. This, in conjunction with the aforesaid biting of foreign matter, further markedly degrades quality.

In the aforesaid vertical type electrolytic apparatus, achievement of electrolytic plating at high current density during high-speed strip streaming of the strip requires efficient feeding of metallic ions to the plating surface and rapid removal the large quantity of gas produced by the high-current-density electrolysis from between the electrodes. The problems posed by these needs have not yet been solved. The vertical type electrolytic apparatus disclosed by JP-A-5-171495 (FIG. 12) still has the following problems:

1) Since the liquid electrolyte 103 is retained solely by electrode units formed by the electrodes 101 and 102 and, furthermore, prevention of liquid electrolyte runout is conducted by the pair of seal rolls 105*a*, 105*b*, the loads on the liquid seal devices 104*a*, 104*b* are excessive, making liquid retention difficult during high-speed strip streaming.
2) Scratching owing to slipping between the strip 100 and the seal rolls 105*a*, 105*b* is liable to occur during high-speed strip streaming and scratching is also produced by foreign matter pressed onto the strip after lodging between the strip and seal rolls.
3) Since the seal rolls themselves experience damage and wear that degrades their liquid seal performance and leads to increased liquid electrolyte leakage, the flow rate required at the electrodes for plating becomes hard to secure and defective plating therefore arises owing to uneven liquid electrolyte flow.

On the other hand, the vertical type electrolytic apparatus disclosed by JP-A-60-56092 (FIG. 13) conducts plating with the electrodes 111 and 112 immersed in the liquid electrolyte 110 and can adequately handle currently used strip running speeds. However, if the strip running speed should be raised to a high level without implementing some measure such as installation of a liquid throttle device or the like, the loss owing to the entrained flow caused by movement of the strip 115 will, as shown in FIG. 1, increase with increasing running speed of the strip, namely, will accelerate up to and reach substantially 100% at around 500 m/min. Even if the strip running speed is further increased to around 1000 m/min, the loss by entrained flow will remain saturated. When this phenomenon occurs, the flow rate between the strip 115 and the electrodes 111, 112 becomes hard to secure and plating defects such as burnt deposits occur.

DISCLOSURE OF THE INVENTION

The present invention was made to overcome the foregoing problems. One of its objects is to provide a method for prevention of plating treatment liquid leakage and utmost avoidance of strip surface scratching and wrinkling. Another of its objects is to provide an electrolytic apparatus with a strip non-contacting liquid throttle unit that can facilitate inter-electrode liquid retention during high-speed strip streaming, prevent clinging of the strip to the electrodes, and enhance plated product quality and plating operation efficiency.

A first aspect of the present invention for achieving these objects provides an electrolytic apparatus with a strip non-contacting liquid throttle unit that, in a method of passing a strip between paired members of a liquid throttle unit provided on at least one of an inlet side and an outlet side of a treatment cell through which the strip is continuously passed, is characterized in that a spacing between the paired members of the liquid throttle unit is set very slightly larger than the thickness of the passed strip to maintain the surfaces of the strip and the liquid throttle unit in a non-contacting state.

A second aspect of the present invention provides an electrolytic apparatus with a strip non-contacting liquid throttle unit according to the first aspect of the invention, characterized in that the paired members of the liquid throttle unit are seal mechanisms and the seal mechanisms comprise at least one means among a pair of seal rolls, a pair of seal blocks and a pair of wedge-shaped seal blocks.

A third aspect of the present invention provides an electrolytic apparatus with a strip non-contacting liquid throttle unit according to the first aspect of the invention, characterized in that the liquid throttle unit is a pair of nozzle devices for jetting and circulating treatment liquid in the treatment cell.

A fourth aspect of the present invention provides an electrolytic apparatus with a strip non-contacting liquid throttle unit according to the first, second or third aspect of the invention, characterized in that the spacing between the passed strip and the pair of seal mechanisms or the nozzle mechanisms is 0.1 mm–5 mm, preferably 0.3 mm–2 mm, larger than the sheet thickness.

A fifth aspect of the present invention provides an electrolytic apparatus with a strip non-contacting liquid throttle unit that, in a method of passing a strip between a pair of seal rolls provided on at least one of an inlet side and an outlet side of a treatment cell through which the strip is continuously passed, is characterized in that a spacing between the pair of seal mechanisms is set 0.1 mm–5 mm, preferably 0.3 mm–2 mm, larger than the sheet thickness to establish a non-contacting relationship between surfaces of the strip and circumferential surfaces of the seal rolls, treatment liquid is throttled in spaces formed by the seal rolls to diminish in the direction of strip advance, and thin film layers of treatment liquid in the treatment cell are formed between the strip surfaces and the circumferential surfaces of the seal rolls to produce a sealing capability with respect to the treatment liquid.

A sixth aspect of the present invention provides an electrolytic apparatus with a strip non-contacting liquid throttle unit according to the fifth aspect of the invention, characterized in that a drive system for rotating the seal rolls is adopted that matches the direction of rotation with the passing direction of the strip and makes the circumferential speed of the seal rolls identical to the running speed of the strip to synchronize the operations of the strip and the seal rolls.

A seventh aspect of the present invention provides an electrolytic apparatus with a strip non-contacting liquid throttle unit that, in an electrolytic apparatus in which a strip is run through an electrode unit formed between electrodes disposed at prescribed spacing, a liquid feeding unit provided on an outlet side of the electrode unit passes liquid electrolyte to the electrode unit to conduct electrolytic treatment, liquid electrolyte after electrolytic treatment is recovered by a waste liquid unit provided on an inlet side of the electrode and a liquid electrolyte tank is provided on the inlet side or the outlet side of the electrode unit to communicate and connect with the electrode unit through the liquid feeding unit or the waste liquid unit, is characterized in that a liquid throttle unit adjacent to the electrode unit and the liquid electrolyte tank filled with liquid electrolyte is a pair of seal mechanisms or nozzle devices spaced facing each other in a non-contacting state with a passed strip and the spacing between the seal mechanisms or the nozzle devices is 0.1 mm–5 mm, preferably 0.3 mm–2 mm, wider than the thickness of the passed strip.

An eighth aspect of the present invention provides an electrolytic apparatus with a strip non-contacting liquid throttle unit that, in an electrolytic apparatus in which a strip is run through an electrode unit formed between opposed electrodes disposed at prescribed spacing, a liquid feeding unit provided on an outlet side of the electrode unit passes liquid electrolyte to the electrode unit to conduct electrolytic treatment, liquid electrolyte after electrolytic treatment is recovered by a waste liquid unit provided on an inlet side of the electrode and a liquid electrolyte tank is provided on the inlet side or the outlet side of the electrode unit to communicate and connect with the electrode unit through the liquid feeding unit or the waste liquid unit, is characterized in that a liquid throttle unit adjacent to the electrode unit and the liquid electrolyte tank filled with liquid electrolyte is formed of two laterally symmetrical seal blocks, preferably wedge-shaped seal blocks, which face each other across a space that diminishes in the direction of strip advance and maintain a non-contacting state with a passed strip, the spacing between the seal blocks being 0.1 mm–5 mm, preferably 0.3 mm–2 mm, wider than the thickness of the passed strip.

A ninth aspect of the present invention provides an electrolytic apparatus with a strip non-contacting liquid throttle unit according to the eighth aspect of the invention, characterized in that the wedge-shaped blocks are equipped with a liquid feeding system for feeding liquid electrolyte from surfaces facing the strip toward the strip over the full width of the strip.

BRIEF DESCRIPTION OF DRAWINGS

FIG. 9(*b*) is a conceptual diagram for explaining the configuration of an electrolytic apparatus showing a mode utilizing another type of wedge-shaped seal block as the fourth embodiment of the present invention.

BEST MODE FOR CARRYING OUT THE INVENTION

The electrolytic apparatus based on the present invention offers a practical technology that is thoroughly compatible not only with current electrolytic apparatuses but also with electrolytic apparatuses with strip running speeds increased to 1000 m/min or 1500 m/min. The electrolytic apparatus further enables prevention of scratches to the strip surface while achieving a sealing effect able to keep pace with increasing strip running speed and, by establishing suitable spacing between the strip surface and the liquid throttle unit, enables utmost prevention of entrained flow of liquid electrolyte owing to strip running.

Figure 1:
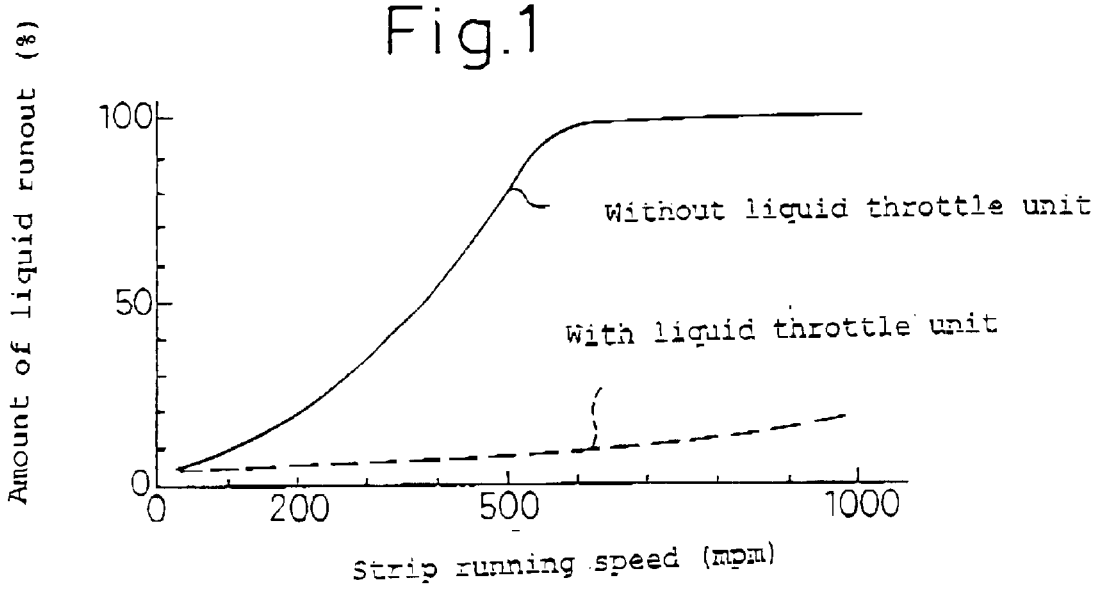
FIG. 1 is a diagram showing the relationship between strip running speed and liquid electrolyte entrained flow.

The inventors first made a study focused on the relationship between strip running speed and a decrease in liquid electrolyte by entrained flow. As a result, they obtained the data shown in FIG. 1. As can be seen from FIG. 1, a proportional relationship exists between the amount of liquid runout by entrained flow and the strip running speed. This is because treatment liquid (liquid electrolyte) used for the treatment has viscosity and the viscous action of the treatment liquid, which flows as a viscous fluid with passage of the strip through the treatment liquid, is drawn along by contact with the strip.

To overcome this problem, a liquid throttle unit comprising paired members is provided to sandwich the running strip in a strip non-contacting state, preferably with the spacing therebetween set very slightly larger than the thickness of the passed strip, and the liquid throttle unit is preferably constituted of a seal mechanism composed of a pair of seal rolls or constituted of a pair of nozzle devices for jetting and circulating liquid electrolyte in the electrolytic cell. Specifically, the seal mechanisms or the nozzle devices are provided on at least one of the inlet side and the outlet side of the electrolytic cell through which the strip is continuously passed, thereby preventing excessive liquid electrolyte adherence and entrained flow while also avoiding occurrence of scratches on the passed strip surface because the liquid throttle unit is itself non-contacting. Tests showed that the aforesaid objects can be achieved if the spacing is made very slightly larger than the thickness of the passed strip, i.e., around 0.1 mm–5 mm, preferably 0.3 mm–2 mm.

Figure 2:
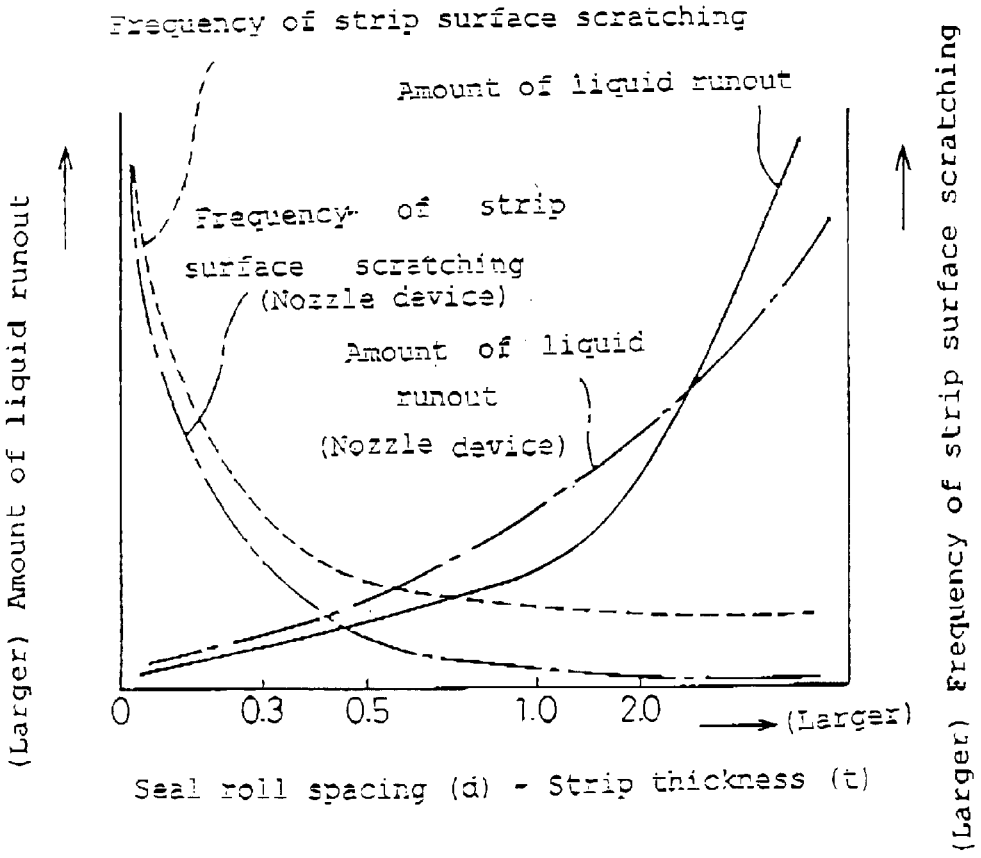
FIG. 2 is a diagram showing the relationship among strip thickness, liquid runout between liquid throttle unit members (seal rolls, seal nozzles), and frequency of strip surface scratching.

In deciding the spacing between the strip surface and the liquid throttle unit members, the inventors conducted tests regarding the relationship among strip thickness, amount of liquid runout through the space between seal rolls and frequency of strip surface scratching and the relationship between amount of liquid runout through the space between nozzle devices and frequency of strip surface scratching. The data shown in FIG. 2 were obtained as a result. As can be seen from FIG. 2, even if the seal rolls or nozzle devices are out of contact with the strip surface, so long as the spacing therebetween is set in the range of 0.1 mm–5 mm larger than the thickness of the passed strip, preferably in the range of 0.3 mm–2 mm larger, entrained flow produced by strip passage is throttled between the seal rolls or by the nozzle devices owing to the diminishing space formed by the seal rolls or the nozzle devices in the direction of strip advance. Specifically, the flow path resistance increases to enable control of liquid electrolyte runout. The reason for limiting this spacing to 0.1 mm–5 mm is that, when using nozzle devices, 0.1 mm is the minimum gap at which contact with the running strip can be avoided and is a sufficient spacing so long as a distance making liquid electrolyte jetting possible can be secured and that at smaller values contact is made with the running strip to increase the frequency of strip surface scratching. It is clear from FIG. 2 that adopting this value lowers the amount of liquid electrolyte runout and enables a marked reduction in the frequency of strip surface scratching. On the other hand, the maximum spacing value of 5 mm corresponds to the maximum thickness of the liquid film drawn along by the strip surface and it was experimentally determined that for obtaining further throttling effect it must be made 2.0 mm, which is the mean value of the liquid film. A spacing greater than 5 mm reduces the frequency of strip surface scratching but is not preferable because it increases the amount of liquid electrolyte runout.

When these maximum and minimum values of the gap are set, a thin film can be formed at the gap where the space formed between the strip and nearest portion of the seal roll surface or the nozzle device. By utilizing this thin film, resistance can be imparted against leakage of the liquid electrolyte in the electrolytic cell. Moreover, the formation of the thin film on the seal roll surface can be promoted by rotating the seal roll.

Even if foreign matter should get mixed into the liquid electrolyte, it is prevented from producing strip surface scratches because it is kept from lodging by the space between the strip and the seal rolls. In addition, wrinkles are not produced even if the strip weaves in its width direction because the seal rolls do not restrict the strip in the thrust direction. By driving the seal rolls to rotate at a circumferential speed identical to the strip running speed, moreover, the relative speed between the circumferential surface of the seal rolls and the strip surface can be made zero to prevent occurrence of strip surface scratches even if the seal rolls should contact the strip.

As a specific electrolytic apparatus applied with the present invention, an example of a vertical type electrolytic apparatus equipped with nozzle devices serving as the liquid throttle unit will now be explained with reference to FIGS. 4 and 5.

Figure 4:
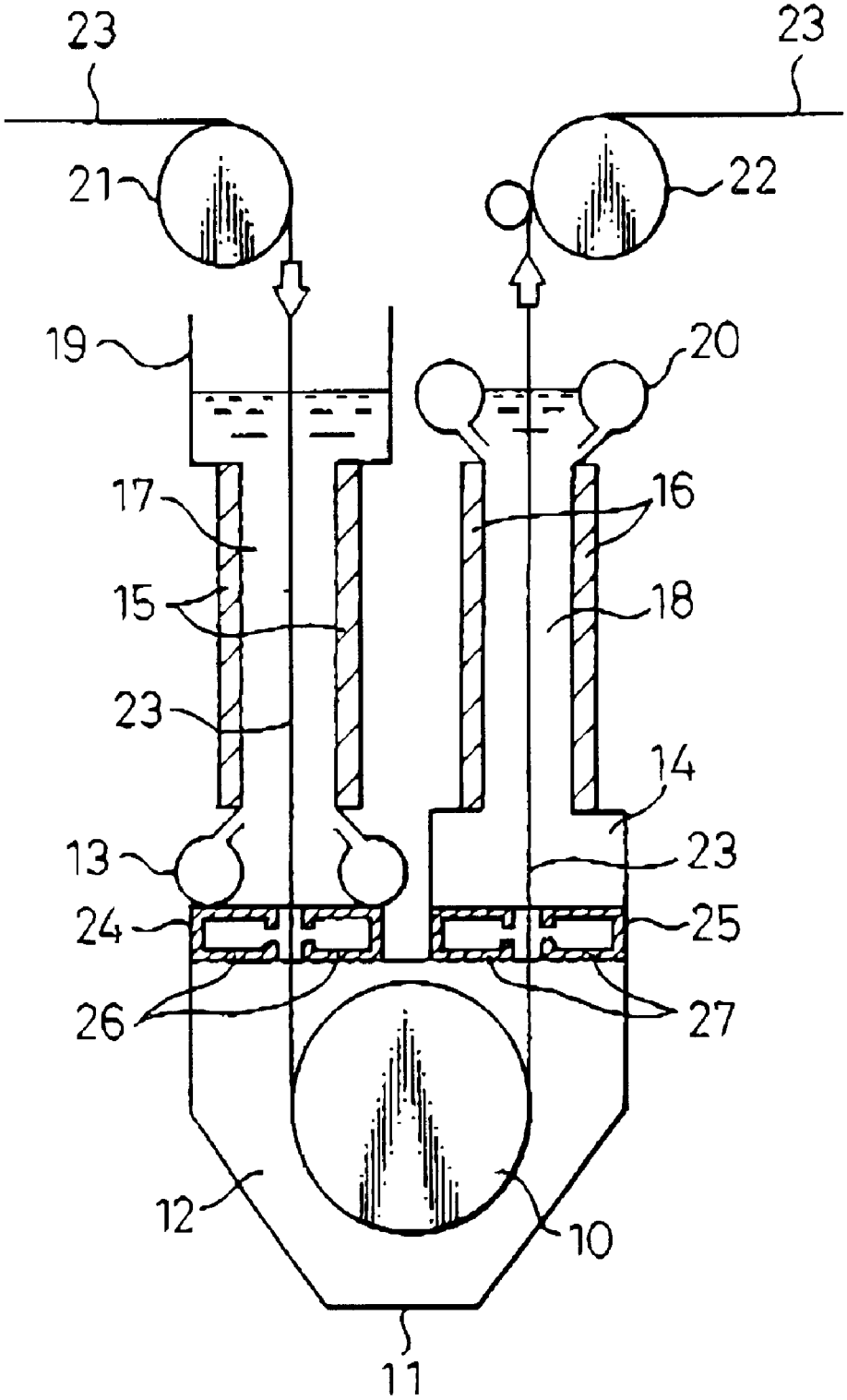
FIG. 4 is a conceptual diagram for explaining the configuration of an electrolytic apparatus that is a first embodiment of the present invention.
Figure 5:
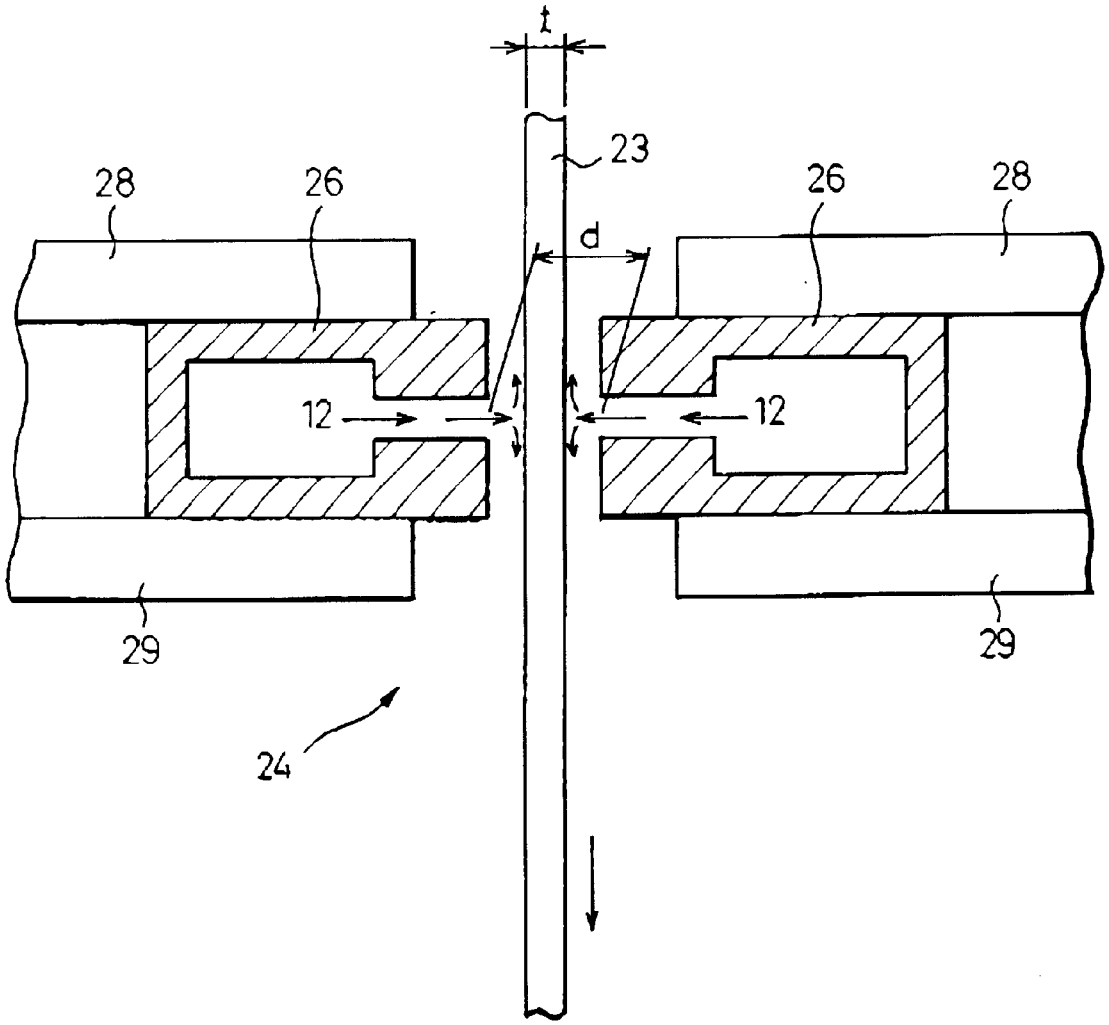
FIG. 5 is an enlarged explanatory diagram of an essential portion in FIG. 4.

As shown in FIGS. 4 and 5, a turn-back roll 10 is rotatably disposed in a lower tank 11 filled with liquid electrolyte. A liquid feeding unit 13 and a waste liquid unit 14 are provided to continue upward from the lower tank 11 and electrode units 17 and 18 are provided to continue upward from the liquid feeding unit 13 and the waste liquid unit 14, respectively. The electrodes unit 17 and 18 are respectively formed between a pair of electrodes 15 and a pair of electrodes 16. Like the lower tank 11, they are filled with liquid electrolyte 12. A waste liquid unit 19 similar to the waste liquid unit 14 is disposed above the electrodes 15 and a liquid feeding unit 20 similar to the liquid feeding unit 13 is disposed above the electrodes 16. Like the lower tank 11, they are filled with liquid electrolyte 12. Conductor rolls 21 and 22 are installed above the waste liquid unit 19 and the liquid feeding unit 20, respectively.

A strip 23 conveyed to the vertical type electrolytic apparatus having the foregoing configuration first wraps over the conductor roll 21 and then descends through the electrode unit 17, reverses direction at the turn-back roll 10, ascends through the electrode unit 18, wraps over the other conductor roll 22 and advances to the next processing step. Simultaneously with the running of the strip 23, liquid electrolyte 12 is fed to the electrode unit 17 from the liquid feeding unit 13 and forcibly imparted with a given flow rate, whereby electrolytic plating is conducted on the strip 23. The liquid electrolyte after electrolytic plating is recovered by the waste liquid unit 14.

In the electrolytic apparatus according to this aspect of the invention, a liquid throttle unit 24 composed of a pair of nozzle devices 26 and a liquid throttle unit 25 composed of a pair of nozzle devices 27 are provided at the upper portion of the lower tank 11 filled with liquid electrolyte 12 at points below the liquid feeding unit 13 and the waste liquid unit 14, respectively, each to sandwich the strip 23 in a state immersed in liquid electrolyte. An enlarged view of this section is shown in FIG. 5. In FIG. 5 (which shows only the strip inlet side of the electrolytic apparatus, the outlet side being omitted because it has the same configuration), the pair of nozzle devices 26 constituting the liquid throttle unit 24 are supported and held in place by upper guides 28 and lower guides 29. The nozzle device spacing (d) is made so that liquid electrolyte 12 can be jetted toward the strip 23 from facing nozzles spaced from each other by a distance that is 0.1 mm–5 mm, preferably 0.3–2 mm, larger than the thickness (t) of the strip 23, whereby the strip can run in a non-contacting state. The strip can be retained at the center of the gap between the opposed nozzles by forcibly jetting liquid electrolyte from the nozzle devices 26 (or 27) disposed to sandwich the strip 23. Therefore, even if the strip should approach one of the nozzles for some reason, the jet from the nozzle prevents contact. Moreover, the jet from the nozzle forms a liquid lubricating layer between the nozzle and the strip that further helps to avoid contact between the two. As this configuration prevents contact and thus enables the spacing to be reduced, the entrained flow of the liquid electrolyte induced by the passage of the strip can be suppressed because the gap through which the liquid electrolyte flows from the electrode unit to the lower tank is throttled to a small size by the liquid throttle unit 24, thereby increasing the flow path loss. Since a sufficient liquid electrolyte flow rate can therefore be obtained at the electrode unit, a uniform flow can be maintained and, as a result, excellent plating can be conducted.

Figure 3:
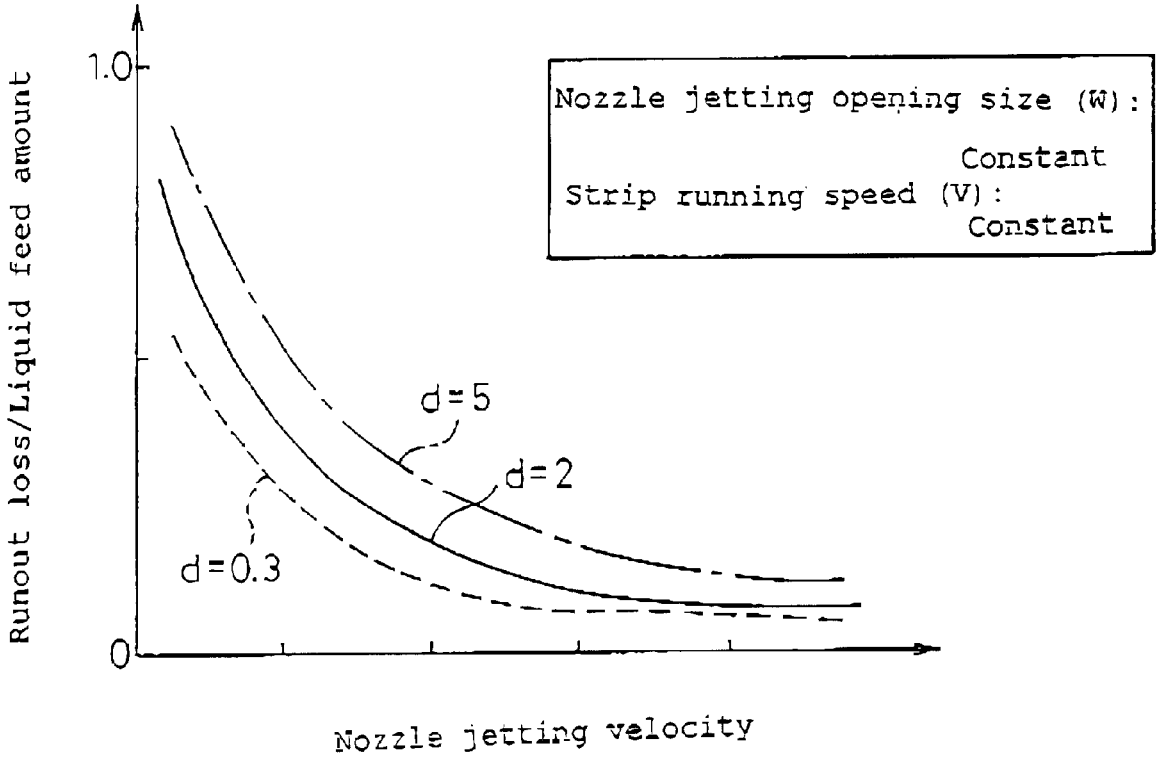
FIG. 3 is a diagram showing the relationship between nozzle jetting velocity and liquid electrolyte runout loss.

Under the foregoing circumstances, explicit ranges apply regarding the jet nozzle spacing, the jetting velocity and the jet opening width as conditions for conducting good quality plating. Specifically, the jet nozzle is preferably 0.1–5 mm, more preferably 0.3–2 mm, the jetting velocity is preferably not less than 7m/sec, and the jet opening width is preferably not less than 0.5 mm. This is because, as shown in FIG. 3, the area of the openings on the inlet side and outlet side of a treatment cell can be throttled and openings for passage of a steel sheet secured by making the spacing between a pair of jet-type shielded nozzles provided one each at the front and back of the steel sheet equal to the thickness of the strip plus 0.1–5 mm, preferably 0.3–2 mm. In addition, the jet impact effect on a steel sheet of a liquid (treatment liquid) jetted from jet-type shielded nozzles can be enhanced by reducing the spacing between the jet-type shielded nozzles. The impact of the jets on the front and back surfaces of the steel sheet supports the steel sheet by the dynamic pressure effect of the jets, prevents contact of the steel sheet with the jet-type shielded nozzles provided at the front and back surfaces thereof, and makes it possible to impart an effect like that of throttling the openings with a physical seal by a curtain of jetted liquid. The reason for defining the jetting velocity as not less than 1 m/sec is to stabilize the dynamic pressure effect produced by the jets. As for the reason for making the jet opening width not less than 0.5 mm, a minimum width of 0.5 mm is defined because otherwise sufficient machining precision of the opening width cannot be obtained and because, owing to the viscosity of the treatment liquid, the feed pressure must be set high to secure jetting velocity.

An example of a vertical type electrolytic apparatus when seal rolls are provided as the seal mechanisms will now be explained with reference to FIGS. 6 and 7. Since the configuration of the vertical type electrolytic apparatus to be explained with reference to FIGS. 6 and 7 is similar to the configuration explained with reference to FIGS. 4 and 5 in all regards aside from the seal mechanisms equipped with seal rolls, the explanation regarding the identically configured portions is made using like reference symbols.

Figure 6:
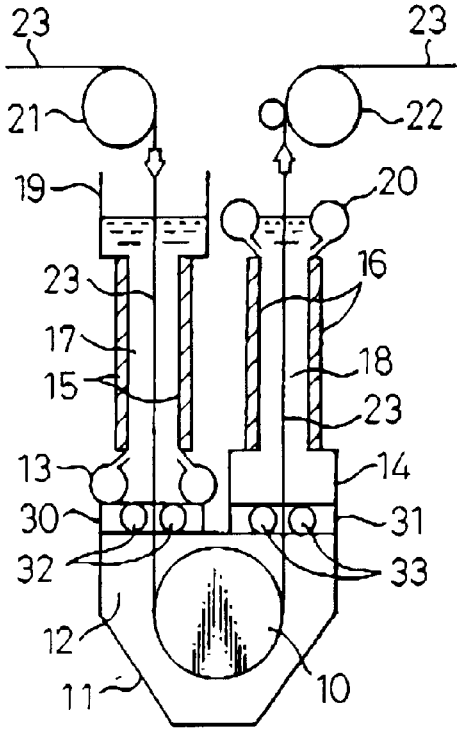
FIG. 6 is a conceptual diagram for explaining the configuration of an electrolytic apparatus using seal rolls that is a second embodiment of the present invention.
Figure 7:
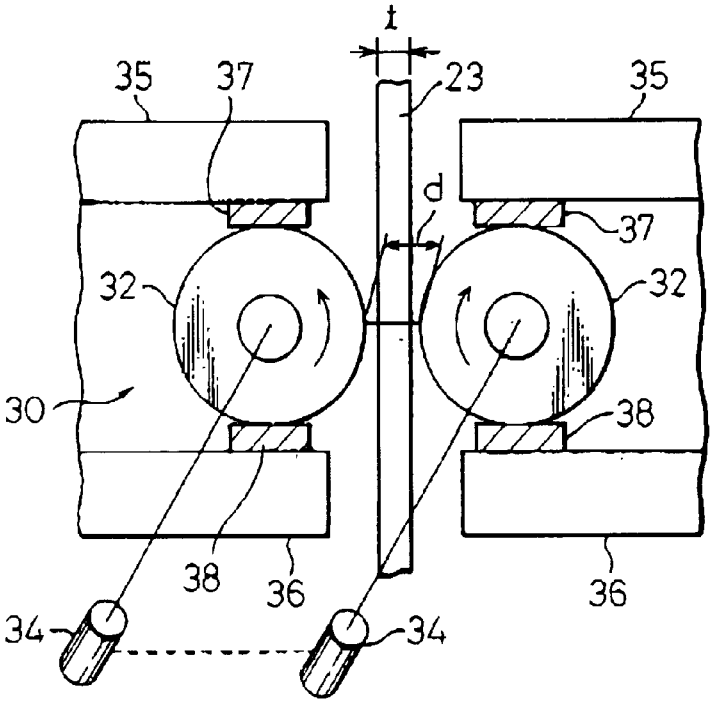
FIG. 7 is an enlarged explanatory diagram of an essential portion in FIG. 6.

As shown in FIGS. 6 and 7, a turn-back roll 10 is rotatably disposed in a lower tank 11 filled with liquid electrolyte 12. A liquid feeding unit 13 and a waste liquid unit 14 are provided to continue upward from the lower tank 11 and electrode units 17 and 18 are provided to continue upward from the liquid feeding unit 13 and the waste liquid unit 14, respectively. The electrode units 17 and 18 are respectively formed between a pair of electrodes 15 and a pair of electrodes 16. Like the lower tank 11, they are filled with liquid electrolyte 12. A waste liquid unit 19 similar to aforesaid waste liquid unit is disposed above the electrodes 15 and a liquid feeding unit 20 similar to the aforesaid liquid feeding unit is disposed above the electrodes 16. Like the lower tank 11, they are filled with liquid electrolyte 12. Conductor rolls 21 and 22 are installed above the waste liquid unit 19 and the liquid feeding unit 20, respectively.

A strip 23 conveyed to the vertical type electrolytic apparatus having the foregoing configuration first wraps over the conductor roll 21 and then descends through the electrode unit 17, reverses direction at the turn-back roll 10, ascends through the electrode unit 18, wraps over the other conductor roll 22 and advances to the next processing step. Simultaneously with the running of the strip, liquid electrolyte 12 is fed to the electrode unit 17 from the liquid feeding unit 13 and forcibly imparted with a given flow rate, whereby electrolytic plating is conducted on the strip 23. The liquid electrolyte after electrolytic plating is recovered by the waste liquid unit 14.

In the vertical type electrolytic apparatus provided with seal rolls as the seal mechanisms according to this aspect of the invention, a liquid throttle unit 30 composed of a pair of seal rolls 32 and a liquid throttle unit 31 composed of a pair of seal rolls 33 are provided at the upper portion of the lower tank 11 filled with liquid electrolyte 12 at points below the liquid feeding unit 13 and the waste liquid unit 14, respectively, in a state immersed in liquid electrolyte 12. An enlarged view of this section is shown in FIG. 7. In FIG. 7 (which shows only the strip inlet side of the electrolytic apparatus, the outlet side being omitted because it has the same configuration), the pair of seal rolls 32 constituting the liquid throttle unit 30 are supported and held in place by upper partitions 35 and lower partitions 36 via interposed seal members 37 and 38 for preventing leakage of the liquid electrolyte 12 at the liquid throttle unit 30. The spacing (d) of the seal rolls 32 is such that the seal rolls 32 face each other separated by a distance that is 0.1–5 mm, preferably 0.3–2 mm, larger than the thickness (t) of the strip 23, whereby the strip runs between the seal rolls in a non-contacting state. The entrained flow of the liquid electrolyte induced by the passage of the strip can be suppressed by this configuration because the gap through which the liquid electrolyte flows from the electrode unit to the lower tank is throttled to a small size by the liquid throttle unit, thereby increasing the flow path loss. Since a sufficient liquid electrolyte flow rate can therefore be obtained at the electrode unit, a uniform flow can be maintained and, as a result, excellent plating can be conducted.

In the embodiments of the electrolytic apparatus according to the invention shown in FIGS. 4 to 7, owing to the provision of the liquid throttle units 24, 25 or 30, 31 between the lower tank 11 and the liquid feeding unit 13 or between the lower tank 11 and the waste liquid unit 14, a stable liquid electrolyte flow rate can be constantly secured between the electrodes at strip running speeds ranging broadly from low speed to high speed. Since the current density can therefore be increased, the plating operation can be conducted with high efficiency and the number of vertical type electrolytic apparatuses installed can be reduced. Particularly noteworthy is that during high-speed strip running at around 1000 m/min, strip passage between the electrodes stabilizes owing to the entrained flow accompanying passage. Since the distance between the electrodes can therefore be shortened, electrolysis can be conducted at a lower voltage to reduce plating power consumption.

Further, as shown in FIG. 7, in the electrolytic apparatus according to second embodiment of the present invention, the seal rolls 32 are rotated by drive motors 34. Since the circumferential speed of the seal rolls 32 are set equal to the running speed of the strip, the seal rolls 32 and the strip 23 can be synchronously operated. Therefore, even if the strip should contact a seal roll, the situation remains substantially the same as if the strip did not contact the seal roll because the strip and the seal roll move at the same speed. Specifically, lodging of foreign matter between the strip and the seal rolls can be minimized and occurrence of harmful scratching owing to lodging of foreign matter can be made almost nil to realize a large improvement in plating quality.

Figure 8:
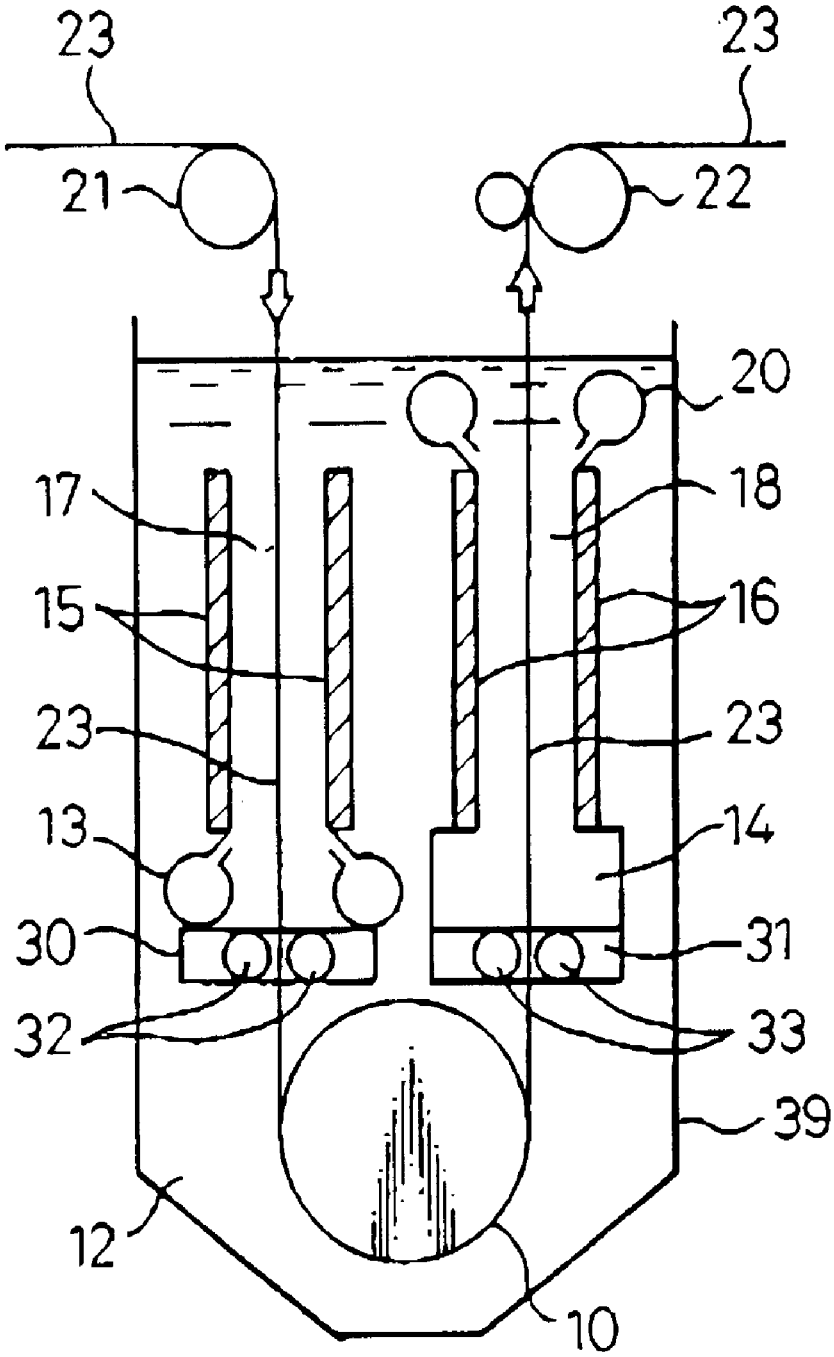
FIG. 8 is a conceptual diagram for explaining the configuration of a large electrolytic apparatus that is a third embodiment of the present invention.

The configuration of a vertical type electrolytic apparatus that is another embodiment of the invention will now be explained with reference to FIG. 8. The apparatus illustrated in FIG. 8 is a vertical type electrolytic apparatus using a large, long cylindrical lower tank 39 in place of the lower tanks shown in FIGS. 4 and 6 and having the constituent elements shown in FIGS. 4 and 6, namely, the liquid feeding units, the waste liquid units, the electrodes and the liquid throttle units, immersed in the liquid electrolyte 12 in the lower tank 39 in the same layout. Owing to the installation of liquid throttle units at an upper portion of the lower tank, the vertical type electrolytic apparatus of FIG. 8 achieves the same effects as the embodiments shown in FIGS. 4 and 6.

Figure 9A:
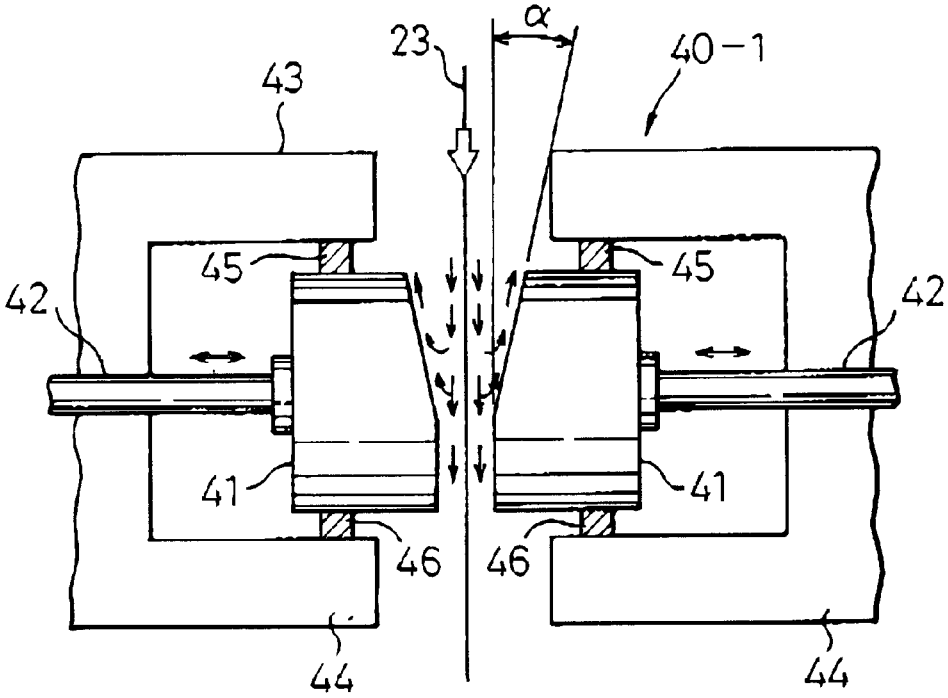
FIG. 9(*a*) is a conceptual diagram for explaining the configuration of an electrolytic apparatus showing a mode utilizing wedge-shaped seal blocks as a fourth embodiment of the present invention.
Figure 9B:
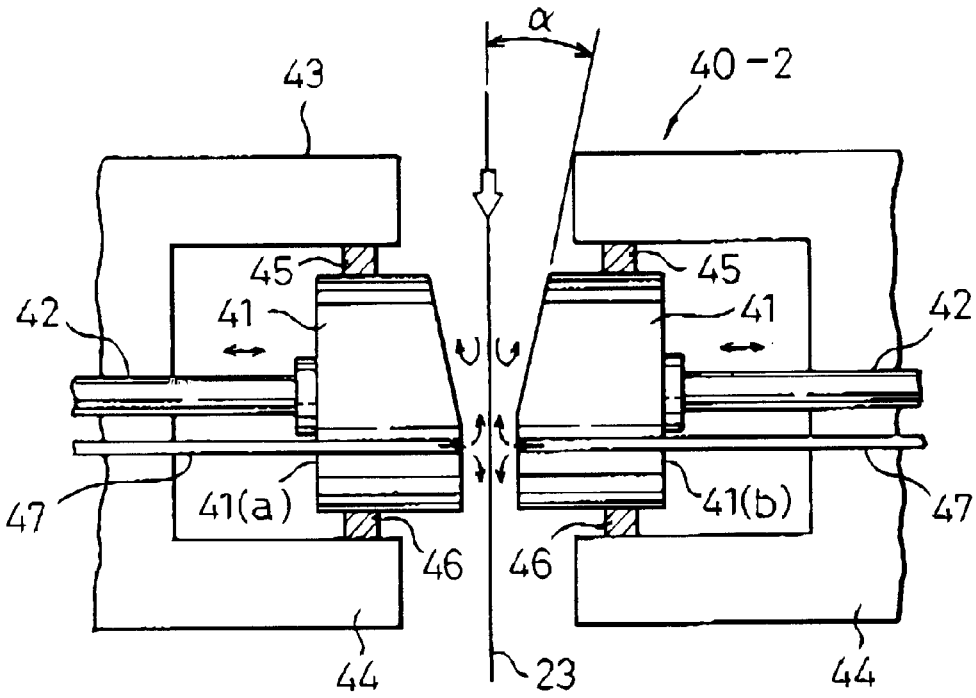

FIG. 9 relates to a vertical type electrolytic apparatus according to the invention that is equipped with seal mechanisms each formed with two wedge-shaped blocks as the liquid throttle unit. FIG. 9(*a*) relates to a vertical type electrolytic apparatus equipped with an advance/retract system for adjusting the spacing between two wedge-shaped blocks and FIG. 9(*b*) relates to a vertical type electrolytic apparatus equipped not only with the advance/retract system but also with liquid feeding pipes for constituting a liquid feeding system that passes through the seal blocks. AS shown in FIGS. 9(*a*) and 9(*b*), the liquid throttle unit 40-1 (40-2) is formed with two laterally symmetrical wedge-shaped seal blocks 41 that face each other across a prescribed space so as to sandwich the strip 23 therebetween and so that the space diminishes in the direction of strip advance. In FIG. 9(*a*), the pair of wedge-shaped seal blocks 41 are supported between upper partitions 43 and lower partitions 44 via interposed seal members 45 and 46 provided for preventing leakage of the liquid electrolyte. The configuration enables the spacing between the wedge-shaped seal blocks 41 to be finely adjusted by driving piston-like advance and retract mechanisms 42 provided on the outward sides. Further, as shown in FIG. 9(*b*), liquid feeding pipes 47 can be provided to constitute a liquid feeding system for feeding the liquid electrolyte 12 from surfaces facing the strip 23 toward the strip 23 over the full width of the strip 23. The liquid feeding pipes 47 can produce a dynamic pressure between the wedge-shaped seal blocks 41*a*, 41*b* and the strip 23 to thereby form a liquid film that can reliably prevent contact between the strip 23 and the wedge-shaped seal blocks 41*a*, 41*b*.

The angle (α) in FIGS. 9(*a*) and 9(*b*) that the oblique straight line connecting the widest portion and the narrowest portion between the pair of wedge-shaped seal blocks 41 makes with the direction of strip 23 advance is preferably in the range of 5° to 30°, more preferably 10° to 15°. This is because such an oblique angle produces a rectification phenomenon with respect to the liquid electrolyte flow entrained by the strip running speed of the strip 23. The spacing between the pair of wedge-shaped seal blocks 41 at the narrowest portion is set to be 0.1 mm–5 mm, preferably 0.3 mm–2 mm, larger than the thickness of the strip 23 so that the strip 23 runs between the wedge-shaped seal blocks 41 in a non-contacting state. By adopting this configuration the entrained flow of the liquid electrolyte 12 induced by the passage of strip 23 can be suppressed because the gaps through which the liquid electrolyte 12 flows from the electrode units 17 and 18 to the lower tank 11 (or 39) is throttled to a small size by the liquid throttle units 41-1 and 41-2, thereby increasing the flow path loss. Since a sufficient liquid electrolyte 12 flow rate can therefore be obtained at the electrode units 17 and 18, a uniform flow can be maintained and, as a result, excellent plating can be conducted.

Figure 10:
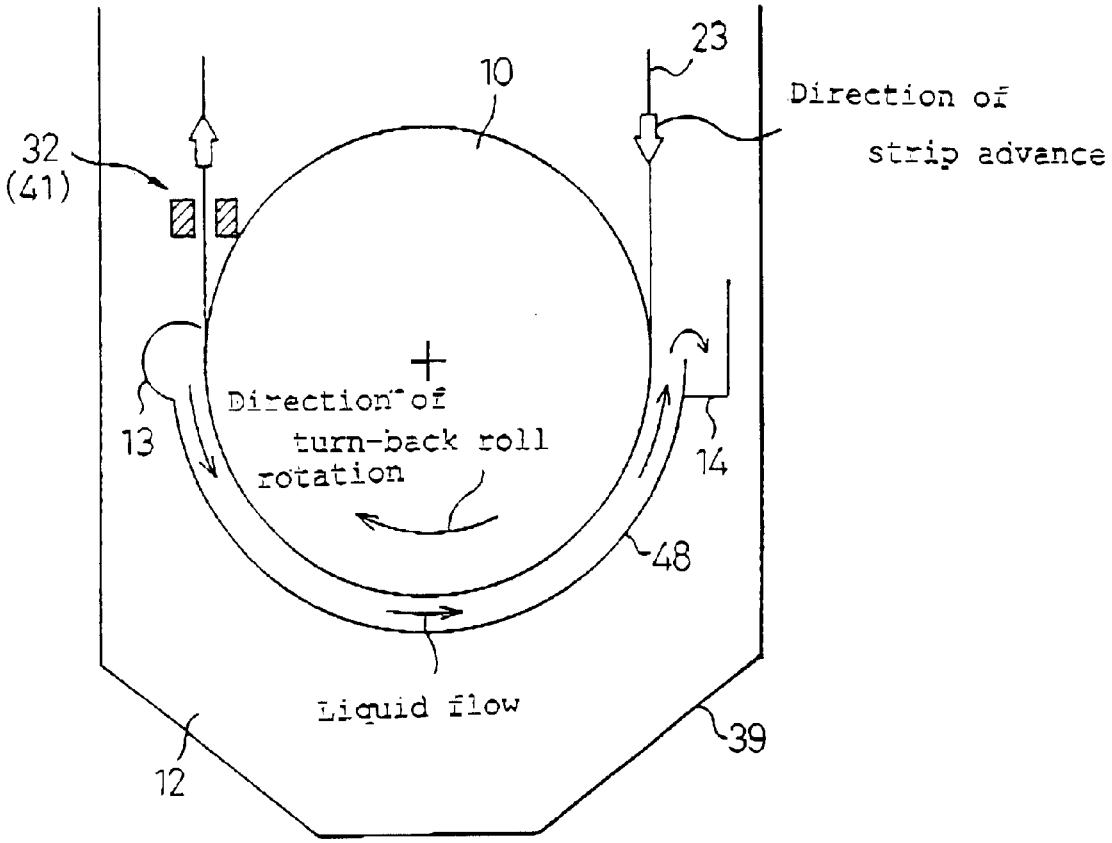
FIG. 10 is a conceptual diagram for explaining the configuration of an electrolytic apparatus that is an electrolytic apparatus according to the present invention, showing a mode in the case of utilizing a single rotary drum.

When the electrolytic apparatus according the present invention has only a single turn-back roll 10 immersed in the liquid electrolyte 12 charged into the lower tank 39, as shown in FIG. 8, the arrangement shown in FIG. 10 can be adopted. Specifically, as shown in FIG. 10, a liquid feeding unit 13 and a waste liquid unit 14 are provided at laterally symmetrical positions relative to the center line of the turn-back roll 10 and the two are made into a unitary structure by installing a guide 48 provided along and spaced a prescribed distance from half the circumferential length of the turn-back roll 10. Liquid electrolyte 12 is supplied from the liquid feeding unit 13 in the direction opposite to the running direction of the strip 23 (in the direction opposite to the rotating direction of the turn-back roll 10) and the liquid electrolyte 12 is discharged from the waste liquid unit 14. In this aspect of the invention, the liquid throttle unit constituted of a seal mechanism or a nozzle device is provided at a location of the strip 23 apart from the turn-back roll 10, namely, directly above the liquid feeding unit 13, whereby entrained flow is suppressed, and a sufficient liquid electrolyte 12 flow rate can be obtained at the electrode unit 12 so that a uniform flow can be maintained and, as a result, excellent plating can be conducted.

Figure 11:
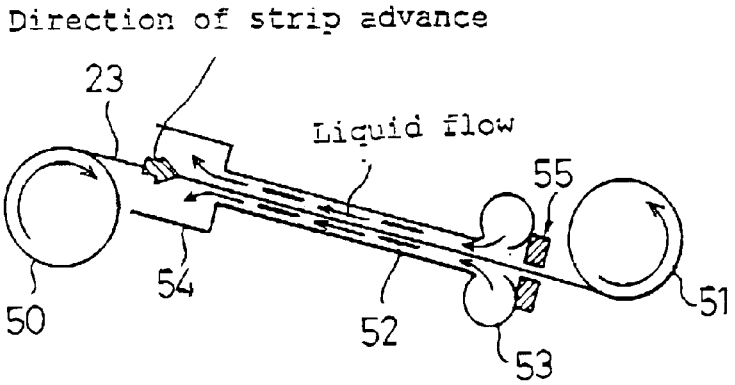
FIG. 11 is a conceptual diagram for explaining the configuration of a horizontal type electrolytic apparatus that is an electrolytic apparatus according to the present invention.
Figure 12:
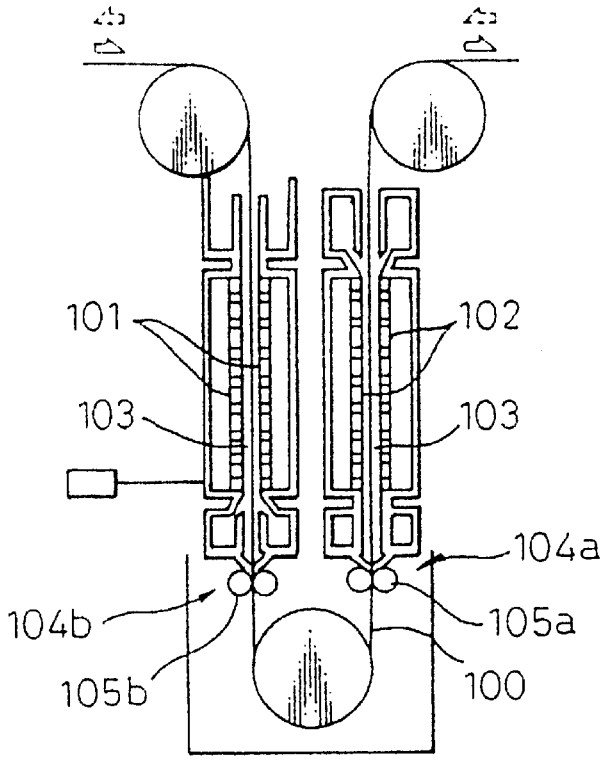
Fig. 12 PRIOR ART
FIG. 12 is a conceptual diagram for explaining the configuration of a conventional vertical type electrolytic apparatus.
Figure 13:
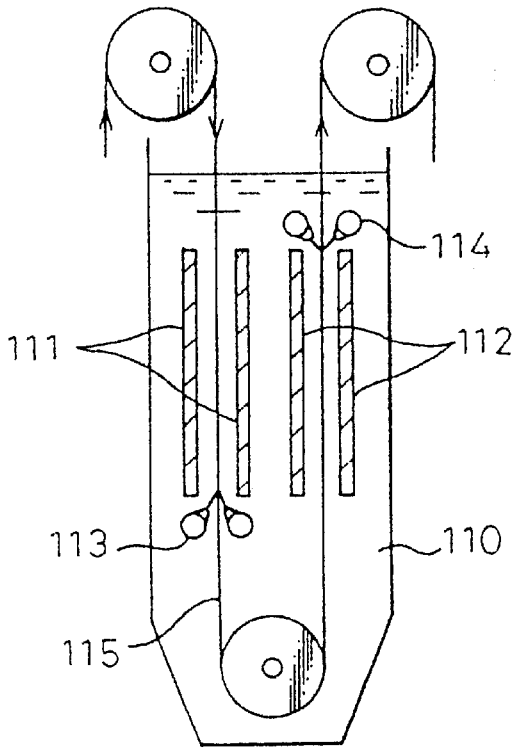
Fig. 13 PRIOR ART
FIG. 13 is a conceptual diagram for explaining the configuration of another example of a conventional vertical type electrolytic apparatus.

The electrolytic apparatus according to the present invention can be a horizontal type electrolytic apparatus instead of a vertical type electrolytic apparatus. An example is shown in FIG. 11. AS can be seen in FIG. 11, the strip 23 to be electrolytically plated wraps over a conductor roll 50 and then moves into a plating apparatus provided with an electrode unit 52. Liquid electrolyte is supplied from a liquid feeding unit 53 provided immediately ahead of a conductor roll 51 of the plating apparatus in the direction opposite to the running direction of the strip 23 in the plating apparatus and is discharged from a waste liquid unit 54. The liquid throttle unit in this aspect of the invention is provided immediately after the liquid feeding unit on the side that the strip 23 exits from the plating apparatus, whereby the sane effects are obtained as in the case of the foregoing vertical type electrolytic apparatuses. Specifically, entrained flow is suppressed and a sufficient liquid electrolyte 12 flow rate can be obtained at the electrode unit 12 so that a uniform flow can be maintained and, as a result, excellent plating can be conducted. Advantages realized by applying the invention to this horizontal type electrolytic apparatus are that the length of the electrolytic plating apparatus footprint can be shortened and installation at a relatively low equipment cost is possible.

INDUSTRIAL APPLICABILITY

As explained in the foregoing, by providing a vertical type electrolytic apparatus with a liquid throttle unit of relatively simple structure, the present invention enables a stable liquid electrolyte flow rate to be constantly secured between the electrodes at strip running speeds ranging broadly from low speed to high speed. Since the current density can therefore be increased, the plating operation can be conducted with high efficiency and the number of vertical type electrolytic apparatuses installed can be reduced. Particularly noteworthy is that strip passage between the electrodes is stabilized during high-speed strip running at around 1000 m/min because liquid runout attributable to the entrained flow caused by strip passage is suppressed to ensure uniform liquid flow between the electrodes. Since the distance between the electrodes can therefore be shortened, electrolysis can be conducted at a lower voltage to reduce plating power consumption.

What is claimed is:

1. An electrolytic apparatus for treating a strip with electrolyte comprising:

a first electrode unit having an inlet side, an outlet side and a pair of spaced apart electrodes disposed between the inlet side and the outlet side;

a first liquid feeding unit provided at the outlet side of the first electrode unit for feeding electrolyte into the first electrode unit;

a first waste liquid unit provided at the inlet side of the first electrode unit for recovering electrolyte from the first electrode unit;

a liquid electrolytic tank provided downstream the first liquid feed unit of the first electrode unit, said liquid electrolyte unit arranged in fluid communication with the first electrode unit through said first liquid feeding unit;

a second electrode unit having an inlet side, an outlet side and a pair of spaced apart electrodes disposed between the inlet side and the outlet side;

a second liquid feeding unit provided at the outlet side of the second electrode unit for feeding electrolyte into the second electrode unit;

a second waste liquid unit provided at the inlet side of the second electrode unit for recovering electrolyte from the second electrode unit;

said liquid electrolytic tank located upstream the second waste liquid unit of the second electrode unit, said liquid electrolyte tank arrange in fluid communication with the second electrode unit through said second waste liquid unit;

a first liquid throttle unit comprising a pair of seal rolls disposed between the first liquid feeding unit at the outlet side of the first electrode unit and the liquid electrolyte tank;

said first pair of seal rolls spaced facing each other in a non-contacting state for passage of the strip therebetween at a spacing between the seal rolls of 0.1 mm to 5 mm wider than the thickness of the strip to be passed through said seal rolls;

a second liquid throttle unit comprising a pair of seal rolls disposed between the second waste liquid unit at the inlet side of the second electrode unit and the liquid electrolyte tank;

said second pair of seal rolls spaced facing each other in a non-contacting state for passage of the strip therebetween at a spacing between the seal rolls of 0.1 mm to 5 mm wider than the thickness of the strip to be passed through said seal rolls.

2. An electrolytic apparatus for treating a strip with electrolyte according to claim 1 further comprising:

means for passing the strip through said electrolytic apparatus at a strip running speed of more than 400 mpm.

3. An electrolytic apparatus for treating a strip with electrolyte according to claim 1 further comprising:

drive system means for rotating the seal rolls in a direction matching the direction of movement of the strip running through the electrolytic apparatus and making the circumferential speed of the seal rolls identical to the running speed of the strip.

* * * * *